US005611299A

United States Patent [19]

Varga et al.

[11] Patent Number: 5,611,299

[45] Date of Patent: Mar. 18, 1997

[54] BOILER WITH REDUCED NOX EMISSION

[76] Inventors: Zeljko Varga, Meljski dol 17, 62000 Maribor; Peter Novak, Pod Kostanji 8, 61000 Ljubljana, both of Slovenia

[21] Appl. No.: 305,693

[22] Filed: Sep. 13, 1994

[51] Int. Cl.[6] ..... F23M 7/04

[52] U.S. Cl. ..... 122/498; 122/367.1

[58] Field of Search ..... 122/497, 498, 122/367.1, 367.2, 367.3

[56] References Cited

FOREIGN PATENT DOCUMENTS

| | | |
|---|---|---|
| 1911608 | 11/1964 | Germany . |
| 1604028 | 8/1970 | Germany . |
| 1579940 | 12/1971 | Germany . |
| 2039619 | 2/1972 | Germany . |
| 9104691 | 7/1991 | Germany . |
| 9101375 | 8/1991 | Germany . |
| 4016880 | 11/1991 | Germany . |
| 4207500 | 9/1993 | Germany . |

*Primary Examiner*—Noah P. Kamen
*Attorney, Agent, or Firm*—Spencer & Frank

[57] ABSTRACT

A boiler has an exterior housing, and a water-cooled fire chamber within the exterior housing having a rear face wall and a front face wall. A door is provided on an end of the exterior housing, and forms the front face wall of the fire chamber. The door is cooled by water circulating therein and has an opening therethrough for a burner producing a flame. The boiler includes an insert having an opening therethrough. The insert surrounds the door opening and is secured to an inside of the door to project into the fire chamber so that the insert opening is essentially aligned with the door opening. The insert is cooled by the water circulating through the door and reduces a cross-sectional area of the fire chamber available for the flame over a portion of the length of the fire chamber. Also provided is a water-cooled partition located in a rear portion of the fire chamber in front of the rear face wall for dividing the flame.

7 Claims, 1 Drawing Sheet

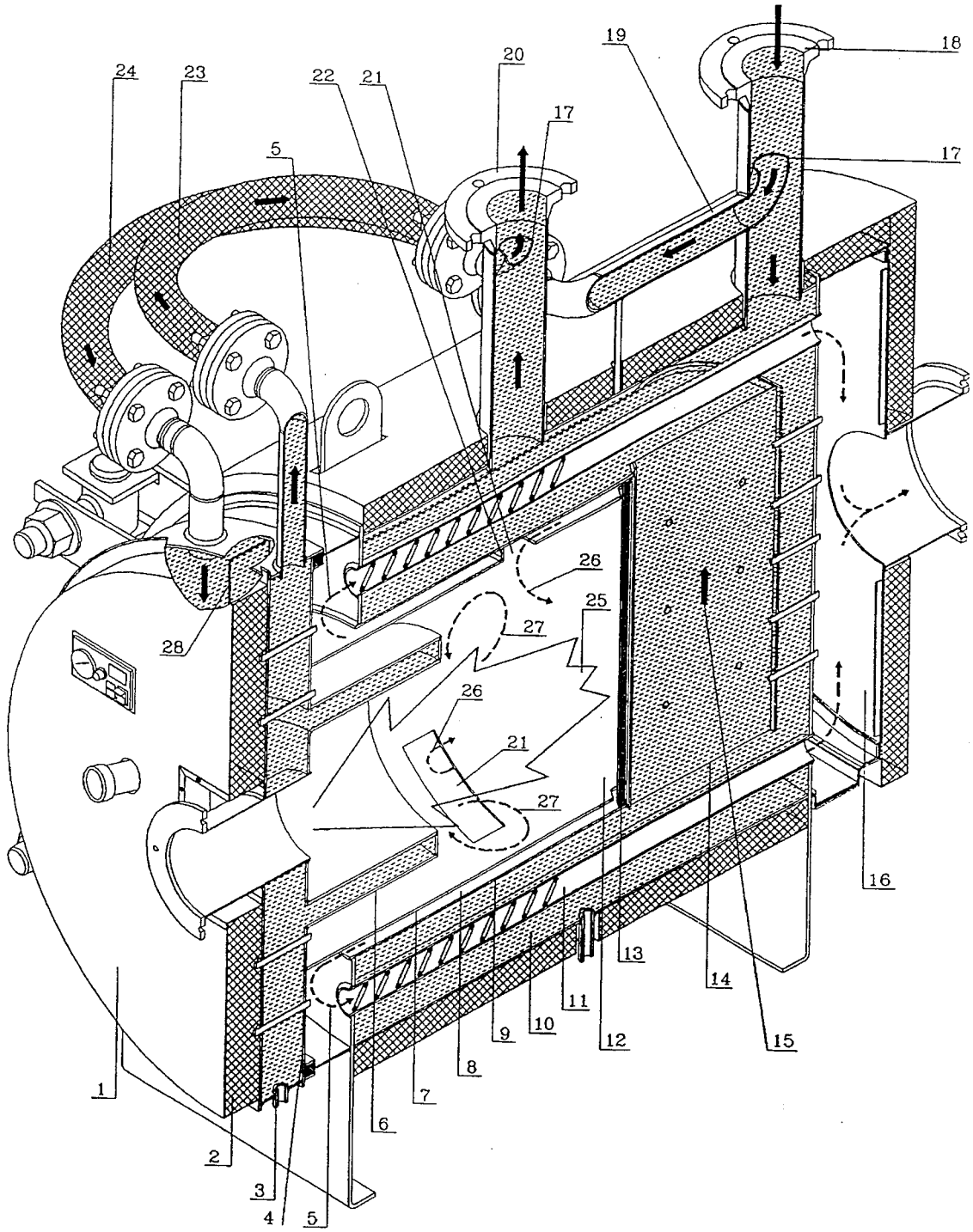
24
23
22
21
20
19
18
17
17
5
26
25
27
28
26
21
27
16
13
14
11
10
9
12
15
8
7
6
1
2
3
4
5

BOILER WITH REDUCED NOX EMISSION

BACKGROUND OF THE INVENTION

The invention relates to a boiler having a fire chamber which is cooled by water, a door which is likewise cooled by water and in which an opening for an oil or gas burner is located, and a water-cooled insert.

A boiler possessing these features is described in DE 40 16 880 A1. Here the entire fire chamber is cooled, namely the annular wall that surrounds the fire chamber in cylindrical fashion as well as the front door and rear face wall.

A warm-water boiler that has a fire chamber rinsed by water is described in DE-AS 1 579 940. This boiler, a hollow rotating body whose diameter increases toward the fire chamber door at the end of the fire chamber at which the door is located. A diffuser-type configuration of the cooling device is intended to be achieved through this measure, with the advantage of attaining a laminar flow of the heating gases, which is intended to reduce the development of noise. The heating surfaces of the boiler are also intended to be acted upon uniformly by the fuel gases, which should increase the efficiency of the boiler.

A steam boiler whose one face wall has a double-cone-shaped insert, and whose double wall has boiler water flowing therethrough, is described in DE-U-1 911 608. The cross-section of the insert tapers toward the interior of the boiler. With this cross-sectional shape, however, no flame can be generated with oil or gas burners. This construction is therefore not used in oil- or gas-fired boilers.

SUMMARY OF THE INVENTION

The object of the invention is to propose a boiler that has the aforementioned features and is distinguished by a low $NO_x$ emission during operation and having a simple design.

In accordance with the invention, the solution to this object is accomplished in that an insert that surrounds the opening is secured to the inside of the door and is cooled with the aid of water circulating in the door. The insert over part of the length of the fire chamber, reduces the cross-section of the fire chamber available to the flame. A partition which divides the flame and is likewise cooled by water is disposed in the rear part of the fire chamber, in front of the rear face wall.

With the aid of the insert, the flow speed in a front part of the flame is perceptibly increased and, because of the pressure difference created by this, a part of the gases is carried back in a natural manner and added to the flames. This re-addition of the already-cooled gases thus cools the fuel gases in the central region of the flame.

Because the insert is connected to the door and cooled by the water circulating in the door the structure is simplified.

The partition according to the invention separates the flame, thereby increasing the flames surface area. This increase in surface area leads to a cooling of the fuel gases. Moreover, the partition is cooled, and the fuel gases are likewise cooled by the contact of the fuel gases with the cooled partition.

Thus, the object of the invention is accomplished.

It is preferred that the partition of the fire chamber be formed from an insert of flame-resistant steel.

It is also preferred that the partition have a flame-resistant protective cover on its face side. The protective cover protects the front side of the partition, which is directly acted upon by the flame.

BRIEF DESCRIPTION OF THE DRAWING

The invention is described in detail below by way of an embodiment. The drawing figure shows a perspective view of an axial section through a boiler according to the invention.

DETAILED DESCRIPTION OF THE INVENTION

The boiler shown is suitable for operation with both gaseous and liquid fuels.

Boiler water 10 circulates in the boiler in the direction of arrows 15. Flue gases 5 exit a fire chamber 12 of the boiler. On the inside 4 of a door 1, the flue gases are diverted into a pipe assembly 11. From there, the flue gases enter an outlet chamber 16, and from the outlet chamber they to the outside.

On its outside, door 1 is clad in a heat insulation

The water is coolest in a return nipple 18. From there, a portion of the water travels via a pipe 19, which branches off from the return nipple 18, to a movable pipe 24, and then into door 1.

The water 10 exits the door 1 through a movable pipe 23, and travels from there into an advance flow nipple 20.

A pipe 17 that serves to increase the water flow through the door 1, and thus to balance the water temperature in the boiler and in the door 1, is provided in the interiors of both the advance flow nipple 20 and the return nipple 18.

A partition 28 of sheet steel directs the flow of boiler water 10 into door 1.

Provided on the inside 4 of the door 1 is a chamber that is likewise cooled by the water and is formed by an annular, cylindrical shaped insert 6, which surrounds the flame 25. Because the velocity of the flue gases 5 is higher in the insert 6 than outside of the insert, a lower pressure is dominant in the insert than fire chamber 12. Depending on the resulting pressure difference, a portion of the flue gases 5 is sucked back into the flame 25 in the direction of the arrows 27. This decreases the temperature of the flame 25, and hence the $NO_x$ formation.

The flame 25 is also cooled more quickly because of the additional surface area created by of the door 1 and the insert 6, which likewise increases the heat transfer in the fire chamber 12.

The $NO_x$ formation is decreased due to the enlargement of the heating surface, defined by the cooled door 1 and the insert 6, which has as a consequence a more rapid cooling of the flame 25.

The inside diameter of the insert 6 can be adapted to the spraying angle of the burner nozzles. The length of the insert 6 should be selected such that it does not prevent the door 1 from being opened.

A connection 3 is provided on the underside of the door 1 for draining the water located in the door.

The flame 25 is also surrounded by an insert 7 made of flame-resistant steel, which prevents the flame 25 from touching the walls 9 of fire chamber 12. Because insert 7 is heated to the red-hot state during operation, soot formation and a precipitation of unburned sulfur from the fuel on the walls 9 of the fire chamber 12 are greatly reduced. Locating the insert 7 in the fire chamber 12 additionally ensures a uniform, convective transfer of heat, even under a partial load. Thus, the efficiency under a partial load is increased. Hence, this leads to an improvement in the overall efficiency, and to a reduction in maintenance costs for the boiler.

When the fuel gases exit the insert 7 in front of the rear part of the fire chamber 12, they are conducted into a conduit 8. The conduit 8 is formed by the outer circular curve of the insert 7 and the inside walls 9 of the fire chamber 12. The flow cross-section of the conduit 8 is smaller than that of the fire chamber 12. For this reason, the flue gases 5 are correspondingly accelerated in conduits, which increases the heat transfer in the fire chamber 12 of the boiler and, at the same time, shortens the amount of time the flue gases 5 remain in the zones of highest temperature. These measures also contribute to the reduction of $NO_x$ formation.

Barriers 22, which are formed by baffle plates, are provided on the circular curve of the insert 7. Openings 21, through which the flue gases 5 are guided back into the flame 25 in the direction of the arrows 26, are provided under the barriers. Because of this, the temperature of the flame 25 and thus the $NO_x$ formation are reduced. The barrier 22 additionally reduces the flow cross-section of the conduit 8, which leads to an additional increase in the heat transfer in the fire chamber 12, i.e. to an increase in boiler output.

A wall (partition) 14 that is cooled in by the up-current of the flow water 10 is provided in the rear part of the boiler chamber 12. The wall 14 is provided on its front side with a flame-resistant covering 13, for example of chamotte. This prevents a direct impact of the flame 25 on the bare wall 14.

With its coating 13, the wall 14 divides the flame 25 into two parts and swirls them. With the additional heating surface of the wall 14, the core of the flame 25 is additionally and more quickly cooled. This leads to a further reduction in $NO_x$ formation and a further increase in boiler output.

The length and thickness of the partition 14 should be dimensioned such that the spread and expansion of the flame 25 is hindered as little as possible.

We claim:

1. An oil or gas burning boiler, comprising:

an exterior housing;

a water-cooled fire chamber within said exterior housing having a rear face wall;

a door on said exterior housing, said door, when closed forming a front face wall of said fire chamber, said door being cooled by water circulating therein and having an opening therethrough for an oil or gas burner producing a flame;

a cylindrical insert having an opening therethrough, said insert surrounding the door opening and being secured to an inside of said door to project into said fire chamber so that the insert opening is essentially aligned with the door opening, said insert being cooled by the water circulating through said door and reducing a cross-sectional area of said fire chamber available for the flame over a portion of the length of said fire chamber; and a water-cooled partition located in a rear portion of said fire chamber in front of the rear face wall for dividing the flame.

2. A boiler as defined in claim 1, wherein said fire chamber has an inside wall comprising a flame-resistant steel insert.

3. A boiler as defined in claim 2, wherein said partition has a side including a flame-resistant protective cover facing said door.

4. A boiler as defined in claim 1, wherein said partition has a side including a flame-resistant protective cover facing said door.

5. A boiler as defined in claim 1, further comprising a plurality of pipes connecting said door with said partition so that the cooling water circulating in the door is in fluid communication with said partition.

6. An oil or gas burning boiler, comprising:

an exterior housing;

a water-cooled fire chamber within said exterior housing having a rear face wall;

a door on said exterior housing, said door, when closed forming a front face wall of said fire chamber, said door being cooled by water circulating therein and having an opening therethrough for an oil or gas burner producing a flame; and a cylindrical insert having an opening therethrough, said insert surrounding the door opening and being secured to an inside of said door to project into said fire chamber so that the insert opening is essentially aligned with the door opening, said insert being cooled by the water circulating through said door and reducing a cross-sectional area of said fire chamber available for the flame over a portion of the length of said fire chamber.

7. A boiler, comprising:

an exterior housing;

a water-cooled fire chamber within said exterior housing and having a rear face wall;

a door on said exterior housing, said door, when closed forming a front face wall of said fire chamber, said door being cooled by water circulating therein and having an opening therethrough for a burner producing a flame; and a water-cooled partition located in a rear portion of said fire chamber in front of the rear face wall for dividing the flame.

* * * * *